United States Patent [19]

Gibbs

[11] Patent Number: 5,039,164

[45] Date of Patent: Aug. 13, 1991

[54] CHAIRS HAVING SWIVEL AND ROCKER FEATURES

[75] Inventor: Terence Gibbs, Nyack, N.Y.

[73] Assignee: Omni Products International, Inc., Fairfield, N.J.

[21] Appl. No.: 402,783

[22] Filed: Sep. 5, 1989

[51] Int. Cl.[5] ..... A47C 1/02

[52] U.S. Cl. ..... 297/302; 248/188.7; 297/285; 297/349

[58] Field of Search ..... 297/285, 295, 297, 300, 297/302, 349, 294; 248/188.7, 188.8

[56] References Cited

U.S. PATENT DOCUMENTS

| | | | |
|---|---|---|---|
| 2,687,765 | 8/1954 | Hurtubise | 297/349 X |
| 2,981,315 | 4/1961 | Schaffer | 297/300 X |
| 3,110,519 | 11/1963 | Chernivsky | 297/285 |
| 3,297,360 | 1/1967 | Holmström | 297/300 |
| 3,441,310 | 4/1969 | Gale | 297/349 X |
| 3,548,810 | 12/1970 | Hoyer | 297/349 X |
| 3,711,152 | 1/1973 | Sirpak et al. | 297/349 X |

FOREIGN PATENT DOCUMENTS

| | | | |
|---|---|---|---|
| 477090 | 9/1928 | Fed. Rep. of Germany | 297/295 |
| 164140 | 12/1933 | Switzerland | 297/297 |
| 468267 | 7/1937 | United Kingdom | 297/302 |
| 474027 | 10/1937 | United Kingdom | 297/300 |

*Primary Examiner*—Peter R. Brown

*Attorney, Agent, or Firm*—Lerner, David, Littenberg, Krumbolz & Mentlik

[57] ABSTRACT

A chair having a seat section, a base section and a support structure interconnecting the seat and base sections for rockably supporting the seat section relative to the base section is disclosed. The support structure includes a resilient member that is generally W-shaped, as viewed in plan, and generally U-shaped, as viewed in elevation. The resilient member includes first and second transversely spaced outer legs fastened to the seat section, and first and second inner legs positioned intermediate the first and second outer legs, when viewed in plan. The inner legs are fastened to the base section. In the preferred embodiment the base section includes upper and lower portions which are pivotable relative to one another. In this case the first and second inner legs are fastened to the upper portion of the base section so that the seat section may be swiveled relative to the lower portion of the base section.

14 Claims, 4 Drawing Sheets

CHAIRS HAVING SWIVEL AND ROCKER FEATURES

BACKGROUND OF THE INVENTION:;

This invention relates to chair structures and, more particularly, to light weight swivel chair structures that include rocker features therein.

Conventional swivel chairs are generally heavy, bulky items due to the necessity of employing materials therein having sufficient strength to withstand the loads imposed on the chairs in service. Moreover, the use of such strong materials has heretofore limited the ability of chair designers to employ rocker features in such lightweight chair structures.

It is, therefore, a primary object of this invention to provide an improved lightweight swivel chair structure that includes a rocker feature therein.

Another object of the present invention is to provide a lightweight chair structure having an improved swivel mechanism therein.

Yet another object of this invention is to provide a lightweight chair structure having an improved rocker feature therein.

Further objects and advantages of the invention will become apparent as the following description proceeds.

SUMMARY OF THE INVENTION

Briefly stated and in accordance with one embodiment of this invention, an improved chair structure comprises a seat section, a base section and means interconnecting the seat and base sections for rockably supporting the seat section relative to the base section. The supporting means includes a resilient member that is generally W-shaped, as viewed in one direction, and generally U-shaped, as viewed in a second directional orthogonal to the first direction. The resilient member includes first and second transversely spaced outer legs fastened to one of the sections and at least a first inner leg positioned intermediate the first and second outer legs and fastened to the other of the sections.

In accordance with another aspect of this invention the chair structure comprises a seat section, a base section and means including an elongated tubular member having a plurality of bends which form a plurality of support legs therein for connecting the seat section to the base section and supporting the seat section on the base section. The base section comprises upper and lower base portions with the upper base portion being mounted on the lower base portion for pivotal movement about a vertical axis relative to the lower base portion. At least first and second ones of the support legs are fixed to the upper base portion and at least third and fourth ones of the support legs are fixed to the seat section so that the seat section is pivotable relative to the lower base section.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION

Figure 1:
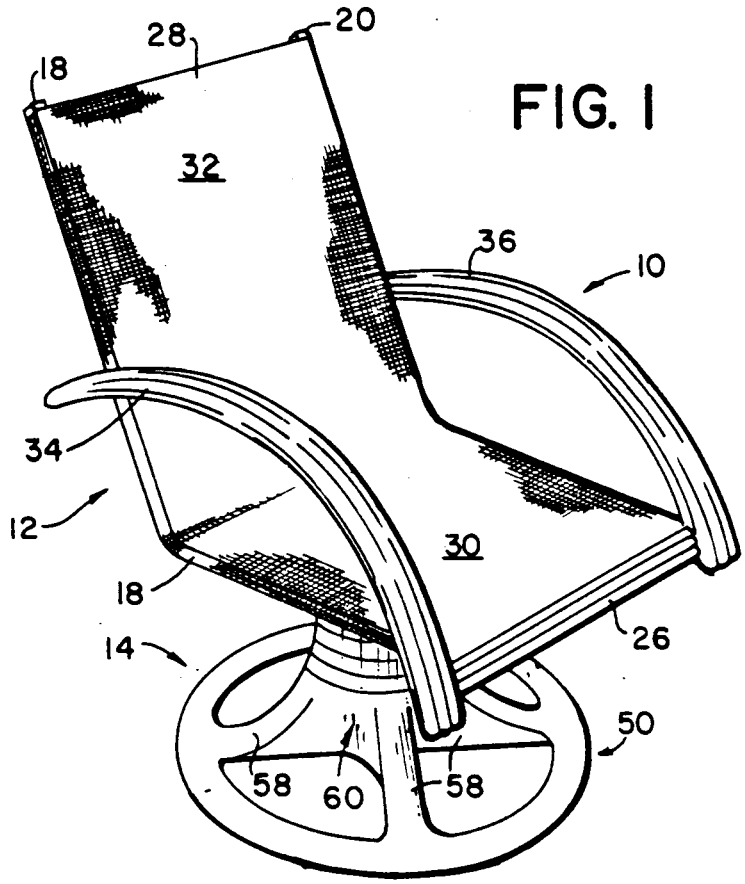
FIG. 1 is a perspective view of a lightweight swivel chair having a rocker feature therein, in accordance with one embodiment of this invention.

Referring to the figures, a chair structure, shown generally at 10 (FIGS. 1 and 2), has there been illustrated. The chair structure 10 includes a seat section, shown generally at 12, a base section shown generally at 14, and a means interconnecting the seat section and the base section for rockably supporting the seat section relative to the base section, shown generally at 16.

The seat section 12 includes first and second transversely spaced, rigid, side support members 18 and 20, respectively, which are held in spaced apart relation by a number of cross bars, including an upper rear cross bar 22, a lower rear cross bar 24 and a lower forward cross bar 26. Each of the cross bars 22, 24 and 26 has one of its ends fixed to side support member 18 and the other of its ends fixed to side support member 20. A conventional open mesh fabric 28, or other suitable flexible material, extends between the transversely spaced side support members 18 and 20, and the opposite sides of the fabric 20 are fixed to such support members in accordance with known practices so that the seat section 12 includes a seat portion 30 and a backrest portion 32. In addition, the seat section 12 is provided with arm rests 34 and 36 which are fixed to the respective side support members 18 and 20 to further rigidify the seat section.

Figure 4:
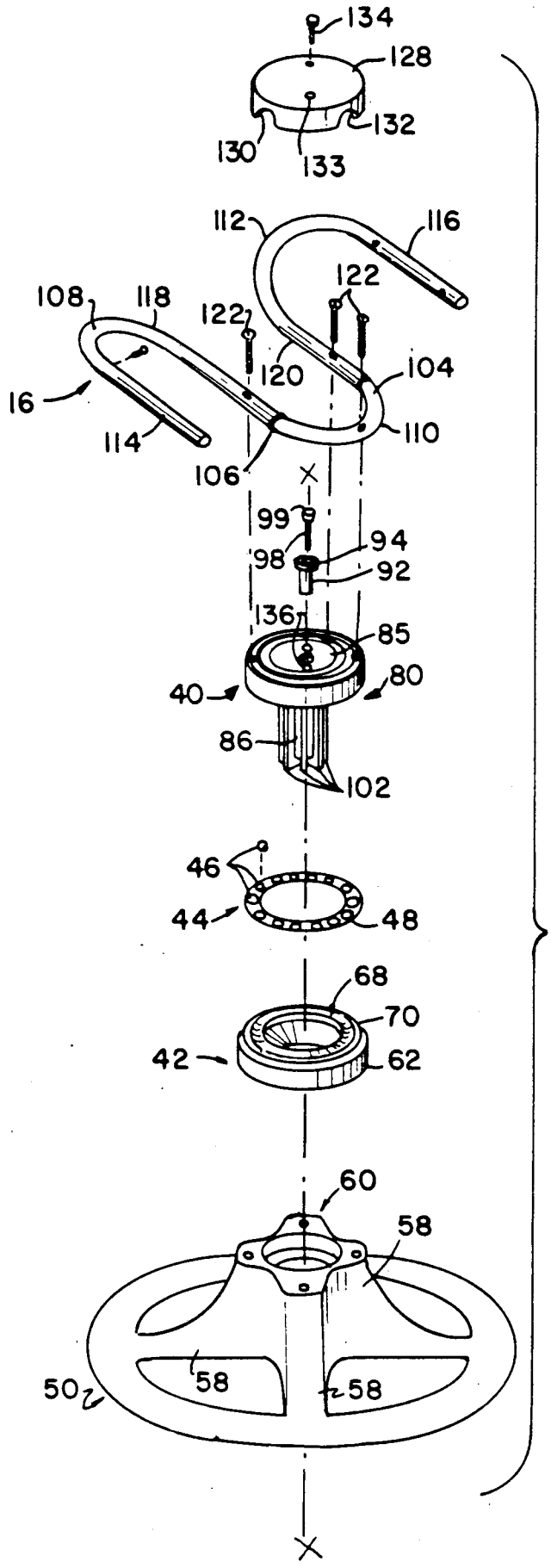
FIG. 4. is an exploded, perspective view of the base section of the chair structure shown in FIG. 3.
Figure 5:
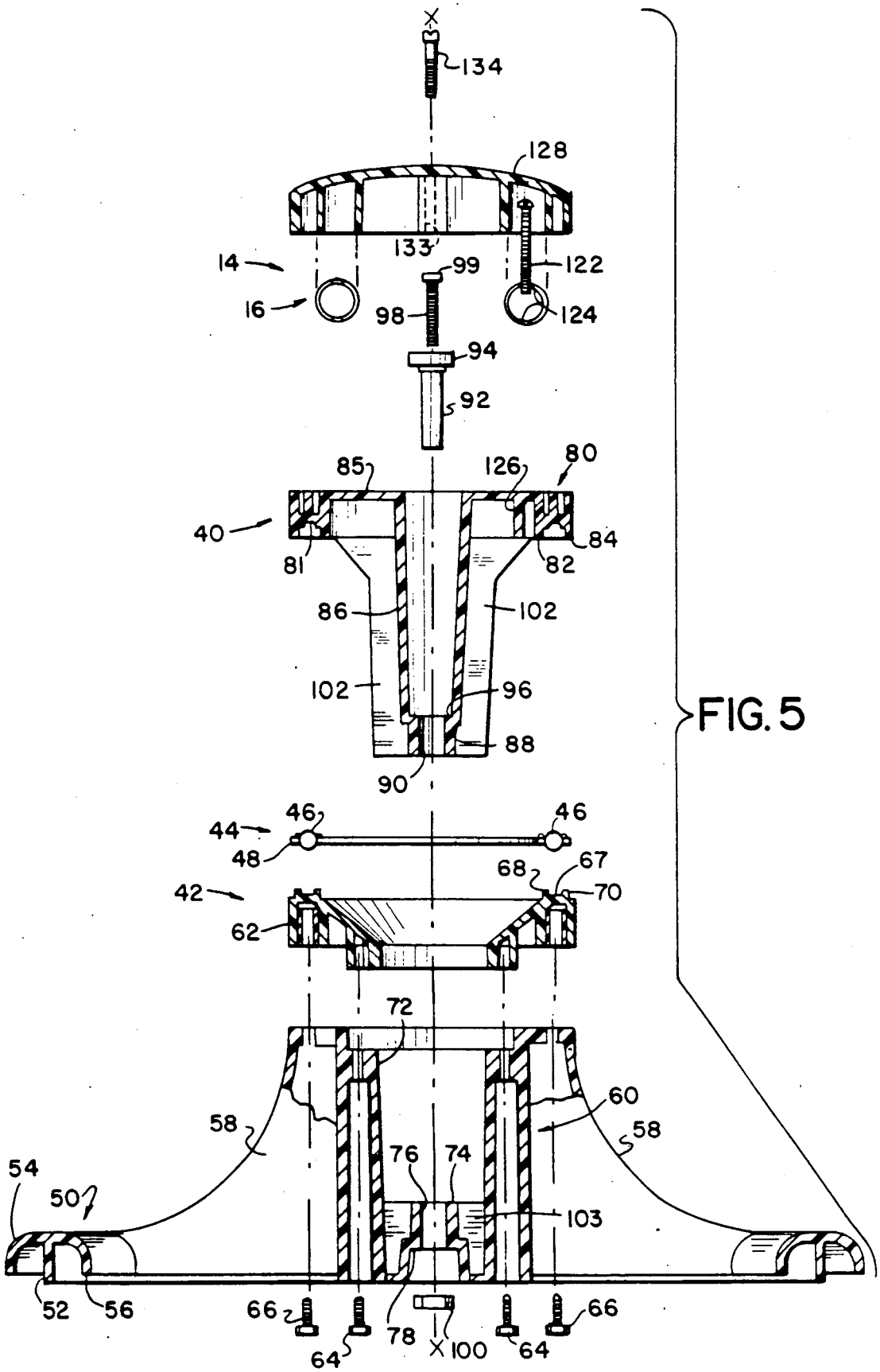
FIG. 5 is an exploded, sectional elevation view of the base section shown in FIG. 3.
Figure 3:
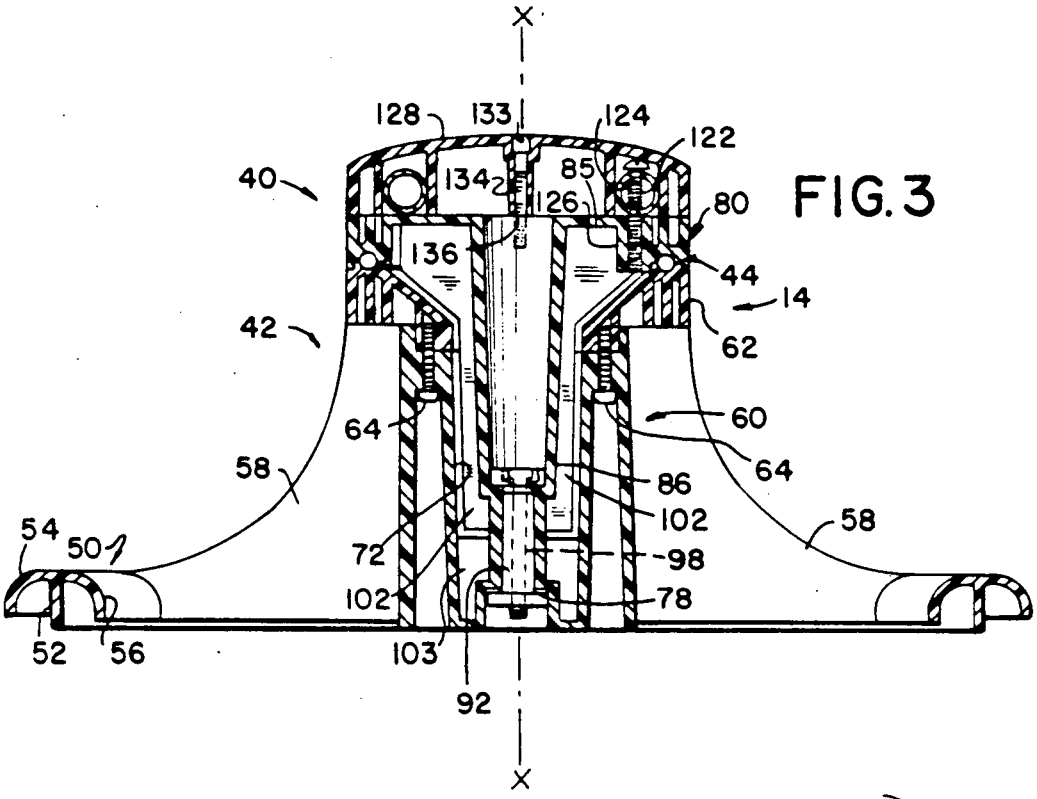
FIG. 3 is an enlarged sectional elevation view, taken along the line 3—3 of FIG. 2, showing details of the base section of the chair structure.

Referring more particularly to FIGS. 3-5, the base section 14 will now be considered in greater detail. Base section 14 includes an upper base portion, shown generally at 40, and a lower base portion, shown generally at 42. Upper base portion 40 is pivotable about a vertical axis X—X relative to lower base portion 42 and is supported on the lower base portion via a ball bearing assembly, shown generally at 44, that includes a plurality of ball bearings 46 held in circumferentially spaced relationship to one another by a retainer ring 48.

Lower base portion 42 of base section 14 includes an annular, floor-engaging rim portion, shown generally at 50, having a downwardly extending flange 52 that normally supports a portion of the weight of the chair and its occupant on the floor. The rim portion 50 includes second and third downwardly extending flanges 54 and 56, respectively, which are slightly shorter than the flange 52. Flanges 54 and 56 aid the flange 52 in supporting an increased portion of the weight of the chair and its occupant in the event that the chair is excessively tilted in a radial direction with respect to its center axis X—X.

The rim portion 50 is connected to a central, generally cylindrical, hub portion, shown generally at 60, by a plurality of generally triangular radial members 58 which are integral with the rim 50 and hub 60 portions. The bottom surface of hub 60 rests on the floor and supports the main portion of the weight of the chair and its occupant. Hub 60 carries an upper bearing support member 62 on its upper surface. Bearing support member 62 is fastened to hub 60 by a plurality of radially inner and outer lock screws 64 and 66, respectively (FIG. 5). The upper surface 67 of bearing support member 62 is provided with radially inner and outer, axially extending, retainer flanges 68 and 70, respectively, which assist in retaining the ball bearing assembly 44 in place between upper base portion 40 and lower base portion 42.

Central hub 60 of lower base portion 42 is provided with a tapered, conical, central opening 72 within the lower portion of which is positioned a mounting boss 74. Boss 74 is integral with an inner wall of hub portion 60 and has an axially oriented aperture 76 therethrough which terminates at a shoulder 78 formed at the lower end of boss 74.

The upper base portion 40 of base section 14 includes a rim portion, shown generally at 80, thereon which is provided on a lower surface 81 thereof with inner and outer downwardly extending retaining flanges 82 and 84, respectively, which are telescopically aligned with the flanges 68 and 70 of bearing support member 62 and serve to assist in retaining the ball bearing assembly 44 in position between the upper and lower base portions 40 and 42. The rim portion 80 is integrally connected via a web 85 to a central, downwardly extending, tapered, conical connecting member 86 which is provided at its lower end with a mounting boss 88 having a central aperture 90 therein. The apertures 90 and 76 of respective bosses 88 and 74 are aligned with one another when the upper and lower base portions 40 and 42 are assembled to one another. A sleeve 92, having an enlarged head 94 thereon, is passed through the aligned apertures 90 and 76. The enlarged head 94 rests against a shoulder 96 formed on the upper end of boss 88.

Sleeve 92 is slightly longer than the combined lengths of apertures 76 and 90 and is provided with a central aperture therein (not shown) through which passes a lock bolt 98, having an enlarged head 99 which engages with a shoulder (not shown) at the upper end of sleeve 92. The lower end of lock bolt 98 extends beyond the bottom end of sleeve 92 (and shoulder 78 of lower boss 74) into engagement with a lock nut 100 which is threaded on the lower end of lock bolt 96 into engagement with the bottom end of sleeve 92 to securely lock the upper and lower portions 40 and 42 of base section 14 in a manner that prevents their vertical separation yet allows the upper portion 40 to pivot on bearing assembly 44 relative to lower base portion 42.

The downwardly extending conical connecting member 86 of upper base portion 40 is provided with a plurality of radially extending vanes 102 which are integral therewith and integral with web 85 and boss 88. Vanes 102 serve to structurally reinforce the web 85, connecting member 86 and boss 88. The outer envelope of vanes 102 is tapered so as to coincide with the conical tapered opening 72 in the hub 60 of lower base portion 42. A slight clearance is provided between vanes 72 and the wall of opening 72 to allow swiveling of the upper base portion relative to the lower base portion. The vanes 102 assist in keeping the connecting member 86 centered within the opening 72 during assembly and use of the chair structure 10 .

The mounting boss 74 of lower base portion 42 is also provided with a plurality of radially extending vanes 103 which are integral therewith and integral with the inner wall of the lower base portion that forms the aperture 72 and surrounds the boss 74. Vanes 103 serve to structurally reinforce the boss 74 and hub 60.

Figure 2:
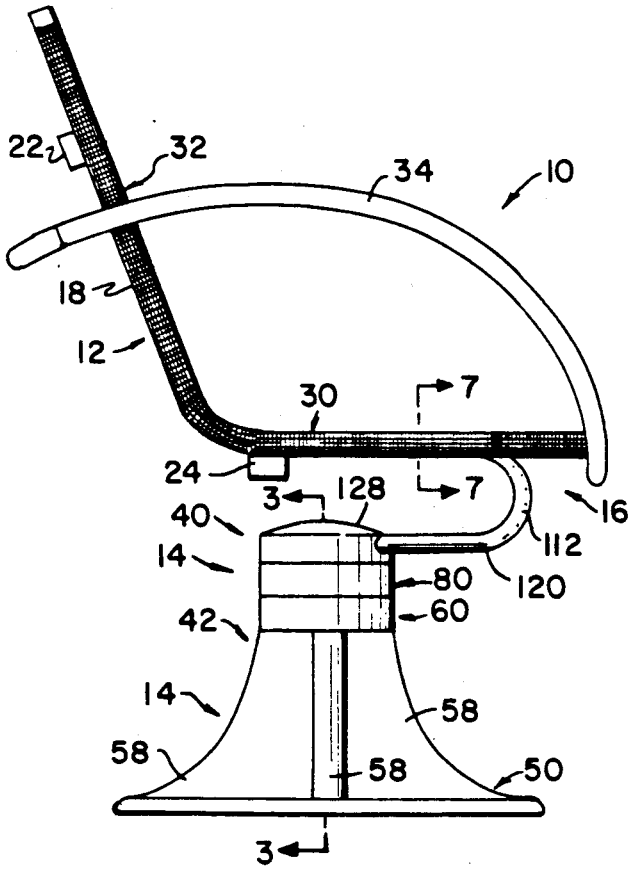
FIG. 2 is a side elevation view of the swivel chair shown in FIG. 1.
Figure 6:
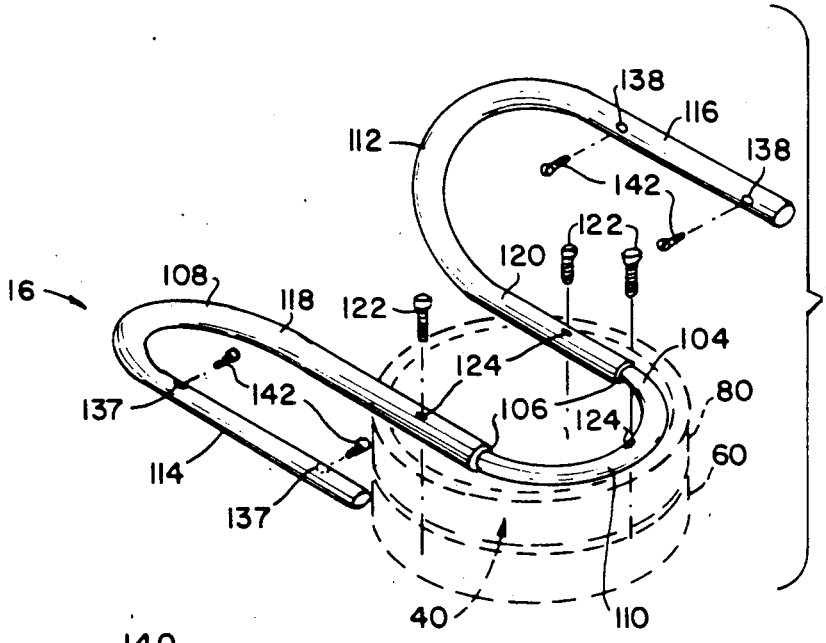
FIG. 6 is an exploded, perspective view of a resilient tubular member that interconnects the chair section and base section of the chair structure and provides the rocker feature thereof; and, FIG. 7 is a sectional elevation view, taken along the line 7—7 of FIG. 2, showing details of the manner in which the tubular member of FIG. 6 is fastened to the upper chair section.

Referring now to FIGS. 2 and 6 in conjunction with FIGS. 3-5, the supporting means 16 for rockably supporting seat section 12 relative to base section 14 will now be considered in greater detail. Supporting means 16 comprises an elongated metallic tube 104, for example steel, that is preferably coated throughout a major portion of its length with a protective plastic coating 106, for example polyvinyl chloride (PVC), and is provided with a number of bends 108, 110 and 112 therein which divide the elongated tube 104 into a plurality of legs, including two outer legs 114 and 116 and two inner legs 118 and 120. When viewed from a first direction, from above (in plan), the tube 110 is bent into the shape of a "W". When viewed from a second direction orthogonal to the first direction, from the side (in elevation) as in FIG. 2, the tube 110 is generally in the shape of a "U" that is lying on its side. The arrangement is such that the legs 114 and 116 are generally coplanar in one plane and the legs 118 and 120 are generally coplanar in a second plane. In the preferred embodiment of this invention the plane of the legs 114 and 116 is positioned above and is parallel to, or nearly parallel to, the plane of the legs 118 and 120.

The metallic tubular member 104 is preferably resilient enough so that the plane of the legs 114 and 116 may be tilted relative to the plane of the legs 118 and 120, due to the additional flexibility of the tube occasioned by the bends 108 and 112, to allow a shift in the weight of the occupant of the chair to cause the plane of the legs 114 and 116 to deflect, thus providing a rocker feature to the chair 10. Legs 118 and 120 are fastened to the upper surface of the rim 80 of upper base portion 40 by a plurality of lock screws 122 which pass through apertures 124 in legs 118 and 120 and threadly engage with internally threaded bosses, one of which is shown at 126 (FIG. 3), that are integrally formed in the upper base portion 40 of base section 14. A cap member 128, having arcuate cutouts 130, 132 (FIG. 4) therein which are adapted to allow the inner legs 118, 120 to pass therethrough, is bolted to the top of upper base portion 80 via threaded bolts 134 which extend through apertures 133. The threaded bolts 134 engage internally threaded apertures 136 formed in the top surface of upper base portion 40. The cap member 128 serves as a decorative shield that covers the portion of the tubular member 104 that is fastened to the rim 80 of upper base portion 40.

Figure 7:
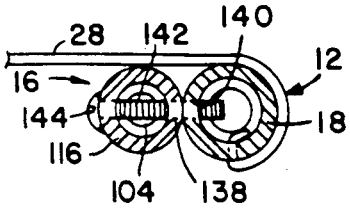

Referring to FIGS. 2, 6 and 7, the manner in which the outer legs 114 and 116 of the supporting means 16 are fastened to the seat section 12 will now be considered in greater detail. Legs 114 and 116 are provided with respective pairs of apertures 137 and 138 which are aligned with corresponding pairs of apertures 140 in side support member 18, one of such apertures 140 being shown in FIG. 7. Threaded lock bolts 142, having enlarged heads 144 thereon, are passed through the apertures 137 and 138 and are threaded into the correspondingly threaded apertures 140 in the side support members 18 and 20 to butt the bolt heads 144 against the legs 114 and 116 and draw the leg 114 to side member 16 and the leg 116 to side member 18, thereby tightly interlocking the legs and side support members.

Thus, with the inner legs 118 and 120 tightly bolted to the upper surface of the rim 80, and the outer legs 114 and 116 tightly bolted to the respective side support members 18 and 20, the supporting means 16 interconnects the seat section 12 and base section 14 in a manner which allows the seat section to rock relative to the base section. Also, since the rim 80 of upper base portion 40 is rotatable or pivotable relative to the lower base portion 42, the seat section 12 may be swiveled relative to the base section 14.

The side support members 16 and 18, cross brace members 22, 24 and 26 and arm rests 34 and 36 are preferably metallic tubular members that are coated with decorative, protective polyvinyl chloride coatings. The upper and lower base portions 40 and 42 and cap 128 are preferably moldings of a strong, light weight material, for example polypropylene (PP), or acrylonitrile butadiene styrene (ABS).

From the foregoing description, it will be apparent that an improved light weight swivel chair structure which includes a rocker feature therein has been provided by the present invention. The light weight chair structure includes both an improved swivel mechanism therein and an improved rocker feature therein, and employs construction materials having sufficient strength to withstand the loads that may be imposed on the chair in service.

While there have been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. A chair structure, comprising a seat section, a base section and means interconnecting said seat and base sections for rockably supporting said seat section relative to said base section, said means including a resilient member that is generally W-shaped, as viewed in plan view, and generally U-shaped, as viewed in a direction orthogonal to said plan view, said resilient member including first and second transversely spaced outer legs fastened to said seat section, and first and second transversely spaced inner legs positioned intermediate said first and second outer legs, when viewed in said plan view, said first and second inner legs joined to each other in a generally U-shape, when viewed in said plan view, said first and second inner legs each being fastened to said base section at a plurality of spaced apart locations, said base section including a rim for supporting said chair structure on the floor, said rim including a middle flange engaging said floor, an inner flange extending to a first spaced distance from said floor and an outer flange extending to a second spaced distance from said floor.

2. A chair structure according to claim 1, wherein said resilient member comprises an elongated tubular metallic member having a plurality of bends therein, said bends serving to integrally interconnect corresponding ones of said inner and outer legs to one another and to connect said inner legs to one another.

3. A chair structure according to claim 1, wherein said base section comprises upper and lower base portions, said upper base portion being mounted on said lower base portion for pivotal movement about a vertical axis relative to said base portion, those of said legs of said resilient member that are fastened to said base section being fastened to said upper base portion of said base section, whereby said seat section and said upper base portion are pivotable relative to said lower base portion.

4. A chair structure according to claim 3, wherein said seat section comprises first and second transversely spaced, rigid, side support members and a seat member extending between and supported by said side support members, and wherein those of said legs of said resilient member which are fastened to said seat section are fastened to said side support members.

5. A chair structure according to claim 1, wherein said first spaced distance is less than said second spaced distance.

6. A chair structure according to claim 1, wherein said middle, inner and outer flanges are concentrically arranged with respect to each other.

7. A chair structure according to claim 1, wherein said base section includes a circular upper base portion having said first and second inner support legs attached thereto about a circumferential portion thereof.

8. A chair structure, comprising a seat section, a base section and means including an elongated tubular member having a plurality of bends which form first and second spaced apart outer support legs and first and second spaced apart inner support legs, said inner and outer support legs connecting said seat section to said base section and supporting said seat section on said base section, said tubular member being generally W-shaped, as viewed in plan view, and generally U-shaped, as viewed in a direction orthogonal to said plan view, said first and second inner support legs positioned intermediate said first and second outer support legs when viewed in said plan view, said first and second inner legs joined to each other in a generally U-shape, when viewed in said plan view, said base section comprising upper and lower base portions, said upper base portion being mounted on said lower base portion for pivotal movement about a vertical axis relative to said lower base portion, said first and second inner support legs being fixed to said upper base portion at a plurality of spaced apart locations and said first and second outer support legs being fixed to said seat section at spaced apart locations, whereby said seat section is pivotable relative to said lower base section, said base section including a rim for supporting said chair structure on the floor, said rim including a middle flange engaging said floor, an inner flange extending to a first spaced distance from said floor and an outer flange extending to a second spaced distance from said floor.

9. A chair structure according to claim 8, wherein said first and second inner support legs are coplanar in a first plane and said first and second outer support legs are coplanar in a second plane.

10. A chair structure according to claim 9, wherein said first and second planes are horizontally parallel and said first plane is positioned below said second plane.

11. A chair structure according to claim 8, including a generally cylindrical hub portion fixed to said rim and having an upper end surface thereon, wherein said upper base portion includes a rim portion having a lower end surface thereon facing said upper end surface, and further including annular bearing means positioned between said upper and lower end surfaces for rotatably supporting said upper base portion on said lower base portion, and fastening means interconnecting said upper and lower base portions and constructed and arranged to allow relative rotation therebetween for preventing said upper and lower base portions from vertically separating from one another.

12. A chair structure according to claim 11, wherein said rim portion of said upper base portion includes an upper end surface thereon, said first and second inner support legs are fastened to said upper end surface of said rim portion, and said upper base portion further includes a cap member positioned over said first and second inner support legs and fastened to said rim portion.

13. A chair structure according to claim 8, wherein said first spaced distance is less than said second spaced distance.

14. A chair structure according to claim 8, wherein said middle, inner and outer flanges are concentrically arranged with respect to each other.

* * * * *